United States Patent [19]

Keefe

[11] 3,973,299

[45] Aug. 10, 1976

[54] FASTENER AND METHOD OF USING SAME

[75] Inventor: Jack D. Keefe, Dayton, Ohio

[73] Assignee: Monarch Marking Systems, Inc., Dayton, Ohio

[22] Filed: Mar. 20, 1975

[21] Appl. No.: 560,433

[52] U.S. Cl. ..... 24/150 FP; 292/322

[51] Int. Cl.[2] ..... B65D 63/16; B65D 55/06

[58] Field of Search ..... 40/21 R, 21 C; 283/18, 283/20; 24/150 FP, 16 PB, 255 BS, 30.5 R, 30.5 S, 73 PF, 90 W, 90 PR, 208 A; 292/307, 322, 325, 318

[56] References Cited

UNITED STATES PATENTS

| | | | |
|---|---|---|---|
| 2,125,313 | 8/1938 | Ringler | 283/18 X |
| 3,339,246 | 9/1967 | Geisinger | 24/16 PB |
| 3,402,435 | 9/1968 | Merser | 24/16 PB |
| 3,462,802 | 8/1969 | Merser | 24/16 PB |
| 3,597,803 | 8/1971 | Van Neil | 24/16 PB |
| 3,600,027 | 8/1971 | Noland et al. | 292/322 |
| 3,753,586 | 8/1973 | Patterson | 292/322 |

FOREIGN PATENTS OR APPLICATIONS

| | | | |
|---|---|---|---|
| 1,002,796 | 8/1965 | United Kingdom | 40/21 R |

*Primary Examiner*—Donald A. Griffin
*Attorney, Agent, or Firm*—Joseph J. Grass

[57] ABSTRACT

There are disclosed two embodiments of a fastener, a method of using a fastener, and a fragmentary portion of a mold. The fastener has a socket and a head joined by a flexible filament. The socket has a disc-shaped body, a transverse opening through the body, projections extending into the opening, and a post joined to each projection. The posts extend into the space within a side wall of the opening. The projections flex when the head is inserted through the opening, but the posts prevent attempted withdrawal of the head through the opening thereby preventing uncoupling of the head from the socket. The projections are so close that when the head is inserted into the socket, some of the plastics polymeric material of the projections deforms permanently, thereby work hardening the projections at the deformation.

22 Claims, 13 Drawing Figures

FASTENER AND METHOD OF USING SAME

BACKGROUND OF THE INVENTION

1. Field of the Invention

This invention relates to the field of fasteners and to methods of using same.

2. Brief Description of the Prior Art

The following U.S. patents disclose fasteners, each having a socket, a projection extending into an opening in the socket and a post or end which is used to prevent withdrawal of the body portion or strap portion from the socket:

| Patentee | Patent No. | Issued |
|---|---|---|
| Geisinger | 3,339,246 | Sept. 5, 1967 |
| Geisinger | 3,590,442 | July 6, 1971 |
| Waddington | 3,735,448 | May 29, 1973 |

The following U.S. patents disclose fasteners, each having a socket and a head joined by a filament:

| Patentee | Patent No. | Issued |
|---|---|---|
| Merser | 3,402,435 | Sept. 24, 1968 |
| Merser | 3,462,802 | Aug. 26, 1969 |
| Merser et al | 3,816,879 | June 18, 1974 |

SUMMARY OF THE INVENTION

The purpose of the invention is to provide a low cost fastener of the loop type which is not adapted to be uncoupled once it is coupled. Certain prior art fasteners are relatively expensive to mold in that the costs of constructing and maintaining the mold are high. Fasteners according to the invention can be produced in a relatively simple multicavity mold. In accordance with a specific embodiment of the invention, there is provided a socket and a head joined by a flexible filament. The fastener is constructed by molding using polymeric plastics material. The one-piece fastener which results from the molding operation can be used as molded or the filament can be stretched to increase the length and strength of the filament. The socket has a through-opening. Projections formed integrally with the socket body extend into the opening. It is preferred that each projection have an integrally formed post or stop adjacent the side wall. While the head is inserted into the socket, the projections flex and consequently the posts move away from the side wall. The head terminates at a shoulder. When the shoulder has cleared the projections, the projections and consequently the posts return substantially to their initial positions. It is preferred that the projections be essentially flat and that the one sides of the projections lie in the same plane as the one side of the body; this construction allows for a relatively simple mold. It is preferred also that the projections lie in the same plane. The projections are shown to take the form of lobes having generally circular outer peripheries. The posts are preferably column-shaped. It is also a feature of the invention that the projections are so close that there is only a small space therebetween through which the head can be inserted. The plastics material of which the projections are molded yields upon passage of the head through the socket with concomitant localized deformation and work-hardening of the projections. The work-hardened projections offer increased resistance to withdrawal of the head through the socket.

The method of the invention comprises the steps of: providing a fastener comprised of flexible, molded, polymeric, plastics material, the fastener having a socket, a head and a flexible filament connected at its one end to the head and at its other end to the socket, the socket having an opening which is small relative to the size of the head, and deforming the socket by inserting the head into the socket with concomitant work-hardening of the socket, whereby withdrawal of the head is resisted by the work-hardened socket.

DETAILED DESCRIPTION OF THE PREFERRED EMBODIMENTS

Figures 1, 2, 3, 4, 5, 6, 7, 8, 9, 10, 11, 12, 13:
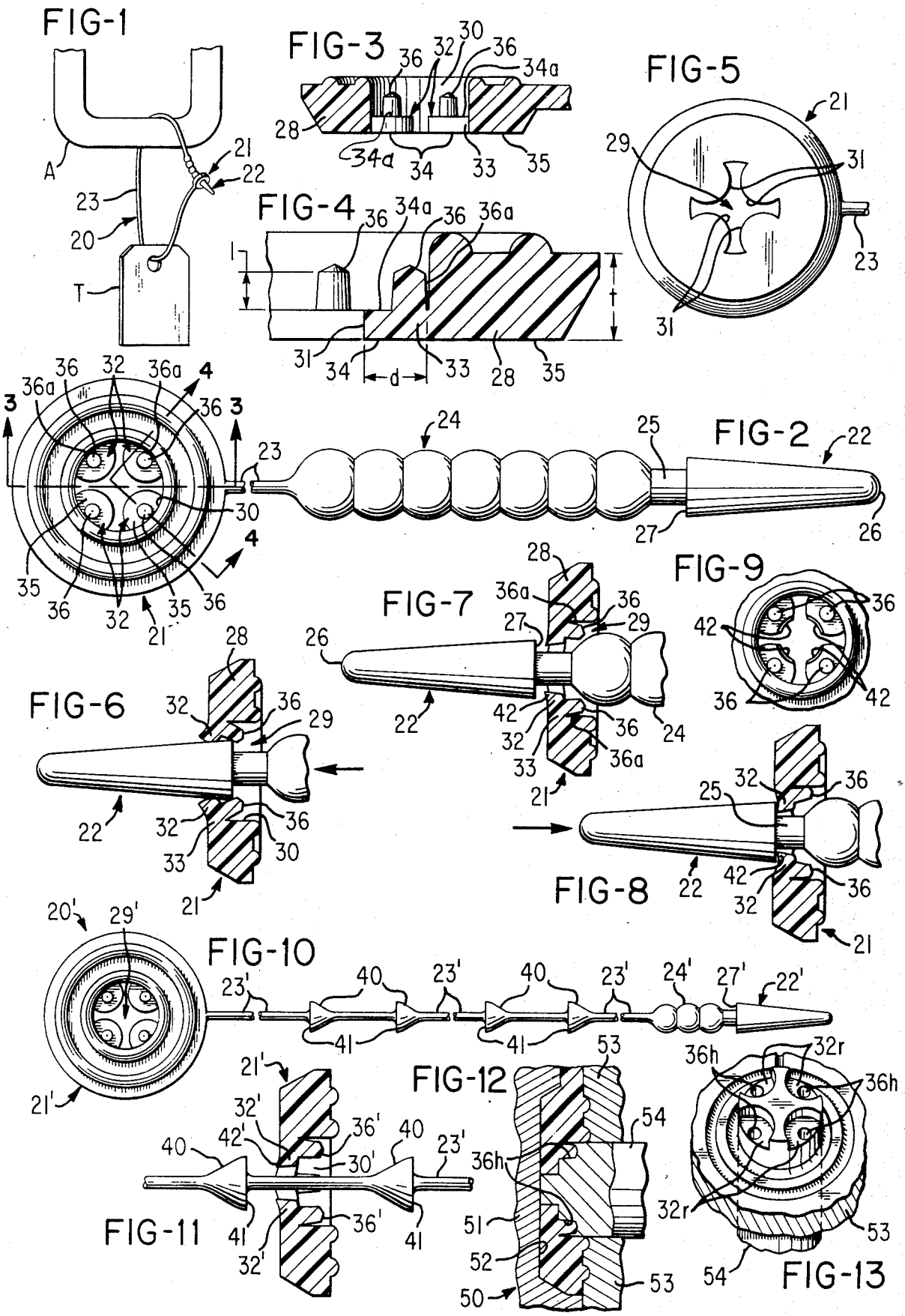
FIG. 1 is a perspective view of a fastener in accordance with the invention used to attach a tag to an article.
FIG. 2 is an enlarged fragmentary view of the fastener.
FIG. 3 is a sectional view taken along line 3—3 of FIG. 2.
FIG. 4 is a sectional view taken along line 4—4 of FIG. 2.
FIG. 5 is a view of the opposite side of a socket of the fastener from that shown in FIG. 2.
FIG. 6 is a fragmentary view of the fastener, showing the head being inserted into the socket.
FIG. 7 is a view similar to FIG. 6, but showing the head as having been inserted through the socket, thereby effecting coupling of the head and the socket.
FIG. 8 is a view similar to FIG. 7, but showing attempted removal of the head from the socket.
FIG. 9 is a fragmentary view of the sides of the socket depicting permanent deformation of the projections effected by insertion of the head into the socket.
FIG. 10 is a fragmentary view of an alternative form of the invention, on a somewhat reduced scale from that used in FIGS. 2 through 9.
FIG. 11 is an enlarged fragmentary view showing the fastener in the coupled position in which at least one of the ratchet teeth has passed through the socket.
FIG. 12 is a sectional view of fragmentary portions of a pair of mold sections and a core pin for molding the fasteners.
FIG. 13 is a fragmentary perspective view of the core pin and one of the mold sections.

With reference to FIG. 1, there is shown a loop-type fastener generally indicated at 20 being used to attach a tag T to an article A, although it is readily apparent that the fastener 20 has a variety of other uses as well. With reference now also to FIGS. 2 through 9, the fastener 20 includes a socket generally indicated at 21, a head generally indicated at 22, and a filament 23 connected to the socket 21 at one end. A relatively stiff roughened manually graspable section generally indicated at 24 is connected to the other end of the filament 23 to a neck 25 which is in turn connected to the head 22. The neck 25 is shown to be circular in section, and the head 22 is shown to be generally conical and to converge generally to its rounded free end 26. The other end of the head 22 terminates at an annular shoulder 27. The section 24, the neck 25, the head 22, and the filament 23 all have the same axis.

The socket 21 preferably has a generally disc-shaped body 28 which is preferably relatively thin, unlike the socket body disclosed in U.S. Pat. No. 3,590,442 which has an elongated or tubular shape. Thinness of the body 28 means that the materials costs can be kept to a minimum. The socket 21 has a short through-opening generally indicated at 29 which is considered to extend in the transverse direction. The shortness of the opening 29 means that socket 21 can be easily released from the mold. The opening 29 is comprised by a side wall 30. The diameter of the section 24 is too large to pass through the opening 29 as is evident from the drawings, especially FIGS. 7 and 8. The projections 32 are joined to the body 28 at their bases 33. The bases 33 of the projections are sufficiently small in section to flex to allow the head 22 to pass through the socket opening 29 as shown in FIG. 6 to the position shown in FIG. 7. As the head 22 passes through the socket opening 29, the posts 36 move inwardly away from the side wall 30 as the projections 32 flex. If the posts 36 are long enough to contact head 22 as the projections 32 flex and posts 36 move inwardly, the posts 36 can flex slightly to permit the passage of the head 22 completely through the socket opening 29, whereupon the projections snap in behind the shoulder 27 of the head 22. The projections 32 are shown to extend inwardly. The projections 32 are shown to comprise lobes, the outer peripheries 31 of which are shown to be circular in FIGS. 2 and 5. The individual projections 32 are shown to be spaced-apart so that they will flex independently. The one sides 34 of the projections 32 lie in a common flat plane with one side 35 of the body 28, as seen in FIGS. 3, 4 and 5. The other sides 34*a* of the projections 32 lie in a common flat plane parallel to the plane in which sides 34 and 35 lie. Although it is preferred to have four projections 32 in the illustrated embodiment, a greater number such as five or a lesser number such as two or three can be provided.

It is preferred that each projection 32 has a post or stop 36 formed integrally therewith and extending from surface 34*a*. The projections 32 are shown to be column-shaped. The axis of each projection 32 is preferably generally parallel to the side wall 30. More particularly, the posts 36 converge slightly to their free ends as best shown in FIG. 4. This aids in removal of the fastener 20 from the mold. It is preferred that the sides 36*a* of the posts 36 be closely adjacent the side wall 30. If an attempt is made to uncouple the head 22 from the socket 21, the sides 36*a* of the posts 36 are urged into abutment with the side wall 30 as best shown in FIG. 8. It is readily apparent that the loop formed by coupling the head 22 with the socket 21 cannot be undone without destroying the fastener 20.

With reference to FIGS. 10 and 11, there is shown an alternative form of fastener 20′ which is identical to the fastener 20, except that its filament 23′ has a plurality of substantially equally spaced-apart generally cone-shaped ratchet elements or teeth 40 disposed along its length. While the fastener 20′ is capable of being coupled by engagement of head 22′ with socket 21′ in the same manner as the fastener 20, section 24′ is small enough so that it will pass readily through opening 29′. The section 24′ is preferably no larger in diameter and most preferably smaller in diameter than the maximum diameter of the head 22′, which maximum diameter exists adjacent shoulder 27′ in the illustrated embodiment. If it is desired to draw the coupled fastener 20′ into a smaller loop, the section 24′ is passed through the opening and the section 24′ and/or the head 22′ can be grasped to draw one or more teeth 40 through the opening 29′. The teeth 40 each have a maximum diameter adjacent their respective annular shoulders which is the same or substantially the same as the maximum diameter of the head 22′ so that once any tooth 40 has passed through the opening as shown in FIG. 10, that tooth cannot be withdrawn due primarily to posts 36′ which cooperate with side wall 30′.

As shown in FIGS. 6 through 9 for the fastener 20 and in FIG. 11 for the fastener 20′, the projections 32 and 32′, respectively, are shown to be permanently deformed. The permanent deformation takes place when the heads 22 and 22′ pass through respective sockets 21 and 21′. As this occurs, the plastics material of which the fastener is composed work hardens and toughens to inhibit withdrawal of the head 22 of the fastener 20 or the head 22′ and teeth 40 of the fastener 20′. Deformation occurs because the plastics material of which the projections 32 and 32′ are composed is compressed and respective permanent ridges or protrusions 42 and 42′ result.

With reference to FIGS. 12 and 13, there is shown a fragmentary portion of a simplified drawing of a mold generally indicated at 50 in which fastener 20 for example can be molded in an injection molding machine. One mold part 51 has a cavity 52 of a relatively simple configuration and the other mold part 53 is fitted with a core pin 54. With reference also to FIG. 13, the core pin 54 includes a plurality of recesses 32*r* for forming projections 32. The portion of the core pin between the recesses 32*r* is cross-shaped and forms the cross-shaped gap between the projections 32 as best shown in FIGS. 2 and 5. The recesses 32*r* are simply formed by a rotary milling cutter and hence outer peripheries 31 of the projections 32 will be circular. The posts 36 are simply formed by drilling the core pin 54 with a slightly tapered drill to form holes 36*h*. The core pin 54 is considerably simpler to make than the core pins of certain prior art molds. This is important in that the mold 50 can be of the 100 cavity type in which 100 such core pins are required.

The fasteners 20 and 20′ are composed of a suitable flexible, molded, polymeric, thermoplastic, plastics material. While nylon is the preferred material due to its flexibility, other materials such as polypropylene can be used. If the fasteners 20 and 21 are desired to be used as-molded, that is, unstretched, then polyethylene is also a satisfactory material from which they can be molded.

By way of example, not limitation, the outer diameter of the socket body 28 is about 0.296 inch, the annular opening provided by side wall 30 has a diameter of about 0.125 inch, the projections 32 have a radius of curvature of about 0.031, the distance *d* of the outer peripheries 31 of a projection to the side wall 30 is about 0.0456 inch, the projections 32 are about 0.015 inch thick, the length 1 of each post 36 is about 0.025 inch, and the thickness *t* of the socket 21 is about 0.060 inch.

Other embodiments and modifications of this invention will suggest themselves to those skilled in the art, and all such of these as come within the spirit of this invention are included within its scope as best defined by the appended claims.

I claim:

1. A one-piece fastener composed of flexible, molded, polymeric, plastics material, the fastener comprising a socket, a head and a flexible filament connected at its one end to the socket and at its other end to the head, the socket including a generally disc-shaped body, an opening extending generally transversely through the body, the opening having a side wall, a plurality of projections joined at their respective bases to the body adjacent the side wall and extending into the transverse opening, and transversely extending posts joined to respective projections, each post extending into the space defined by the side wall in a location adjacent the side wall, at least the bases of the projections being sufficiently small in section to enable the projections to flex as the head is inserted through the opening to effect coupling of the head with the socket, the sides of the respective posts being urged into contact with the side wall upon attempted withdrawal of the head through the opening thereby preventing uncoupling of the head from the socket.

2. A fastener as defined in claim 1, wherein one side of the body and the one sides of the respective projections lie in the same plane.

3. A fastener as defined in claim 1, wherein one side of the body and the one sides of the respective projections lie in the same plane, and the posts terminate in the space within the opening.

4. A fastener as defined in claim 1, wherein the projections have generally flat opposite sides.

5. A fastener as defined in claim 1, wherein the projections are spaced-apart lobes, the outer peripheries of the lobes being generally circular, and the opposite sides of the lobes being generally flat.

6. A fastener as defined in claim 1, wherein the head is elongated and converges toward its free end, the other end of the head having a shoulder, the shoulder being of such a size that attempted withdrawal by pressure of the shoulder against the sides of the respective projections opposite the posts will prevent flexure of the projections while the sides of the posts are in contact with the side wall.

7. A fastener as defined in claim 1, wherein the posts are generally column-shaped.

8. A fastener as defined in claim 1, including a plurality of spaced-apart teeth disposed along the filament.

9. A fastener as defined in claim 1, wherein the plastics material is permanently deformable, wherein the outer peripheries of the projections are so close as to leave only a small space through which the head can be inserted so that the head deforms the outer peripheries permanently as it passes between the projections.

10. A fastener as defined in claim 1, wherein each projection has a post.

11. A one-piece fastener composed of flexible, molded, polymeric, plastics material, the fastener comprising a socket, a head and a flexible filament connected at its one end to the socket and its other end to the head, the socket including a body and an opening extending through the body, the opening having a side wall, a plurality of projections joined at their respective bases to the body adjacent the side wall and extending generally radially inwardly into the opening, the projections being disposed generally in the same plane, and a post joined to at least one of the projections, the post extending into the space within the side wall, the post having a side closely adjacent the side wall, the bases of the projections being sufficiently small in section to enable the projections to flex as the head is inserted through the opening to effect coupling of the head with the socket, the side of the post being urged into contact with the side wall upon attempted withdrawal of the head thereby preventing uncoupling of the head from the socket.

12. A fastener as defined in claim 11, wherein at least two of the projections have posts.

13. A fastener as defined in claim 11, wherein the plastics material is permanently deformable, wherein the outer peripheries of the projections are so close as to leave only a small space through which the head can be inserted so that the head deforms the outer peripheries permanently as it passes between the projections.

14. A one-piece fastener composed of flexible, molded, polymeric, plastics material, the fastener comprising a socket, a head and a flexible filament connected at its one end to the socket and at its other end to the head, the socket including a body and an opening extending through the body, the opening having a side wall, a plurality of projections joined at their respective bases to the body adjacent the side wall and extending inwardly into the opening, and a post joined to at least one of the projections, the post extending into the space within the side wall, the bases of the projections being sufficiently small in section to enable the projections to flex as the head is inserted through the opening to effect coupling of the head with the socket, the side of the post being urged into contact with the side wall upon attempted withdrawal of the head thereby preventing uncoupling of the head from the socket.

15. A fastener as defined in claim 14, wherein the plastics material is permanently deformable, wherein the outer peripheries of the projections are so close as to leave only a small space through which the head can be inserted so that the head deforms the outer peripheries permanently as it passes between the projections.

16. A fastener as defined in claim 14, including a substantially rigid, roughened manually graspable section connecting the other end of the filament to the head.

17. A fastener as defined in claim 14, wherein at least two of the projections have posts.

18. A one-piece fastener composed of flexible, molded, polymeric, plastics material, the fastener comprising a socket, a head and a flexible filament connected at its one end to the socket and at its other end to the head, the socket including a generally disc-shaped body, an opening extending generally transversely through the body, the opening having a side wall, a plurality of spaced-apart generally flat projections joined at their respective bases to the body adjacent the side wall and extending into the transverse opening, the projections being disposed in the same plane, the projections extending generally radially inwardly toward each other, wherein one side of the body and the one sides of the respective projections lie in the same plane, and a transversely extending post joined to each projection, each post extending into the space within the side wall and being disposed closely adjacent the side wall, at least the bases of the projections being sufficiently small in section to enable the projections to flex as the head is inserted through the opening to effect coupling of the head with the socket, the sides of the respective posts being urged into contact with the side wall upon attempted withdrawal of the head through the opening thereby preventing uncoupling of the head from the socket.

19. A fastener as defined in claim 18, wherein the posts terminate in the space within the side wall, wherein the projections are lobes, outer peripheries of the lobes being generally circular, wherein the posts are generally column-shaped, and wherein the body is relatively thin.

20. A fastener as defined in claim 18, wherein the plastics material is deformable, wherein the outer peripheries of the projections are so close as to leave only a small space through which the head can be inserted so that the head deforms the outer peripheries permanently as it passes between the projections.

21. A one-piece fastener comprised of flexible, molded, polymeric, plastics material, the fastener comprising a socket, a head and a flexible filament connected at its one end to the head and at its other end to the socket, the head terminating at a shoulder, the socket having an opening which is small relative to the size of the head so that the socket is deformed when the head is inserted into the socket and wherein some of the material of the socket deforms permanently with concomitant work-hardening of the socket, whereby withdrawal of the head is resisted by the work-hardened socket.

22. Method of using a fastener comprising the steps of: providing a fastener comprised of flexible, molded, polymeric, plastics material, the fastener having a socket, a head and a flexible filament connected at its one end to the head and at its other end to the socket, the socket having an opening which is small relative to the size of the head, and deforming the socket permanently by inserting the head into the socket with concomitant work-hardening of the socket, whereby withdrawal of the head is resisted by the work-hardened socket.

* * * * *